US011033160B2

(12) United States Patent
Ruehle

(10) Patent No.: US 11,033,160 B2
(45) Date of Patent: Jun. 15, 2021

(54) FLUSHING AND CLEANING SYSTEM AND FLUSHING METHOD FOR A TOILET

(71) Applicant: Armin Ruehle, Eppingen (DE)

(72) Inventor: Armin Ruehle, Eppingen (DE)

(73) Assignee: Armin Ruehle, Eppingen (DE)

( * ) Notice: Subject to any disclaimer, the term of this patent is extended or adjusted under 35 U.S.C. 154(b) by 0 days.

(21) Appl. No.: 16/487,165

(22) PCT Filed: Apr. 10, 2017

(86) PCT No.: PCT/DE2017/000102

§ 371 (c)(1),
(2) Date: Aug. 20, 2019

(87) PCT Pub. No.: WO2018/149427

PCT Pub. Date: Aug. 23, 2018

(65) Prior Publication Data

US 2020/0054179 A1 Feb. 20, 2020

(30) Foreign Application Priority Data

Feb. 20, 2017 (DE) ..... 10 2017 001 775.1

(51) Int. Cl.

| | |
|---|---|
| ***A47K 13/30*** | (2006.01) |
| ***E03D 9/05*** | (2006.01) |
| ***E03D 11/02*** | (2006.01) |

(52) U.S. Cl.

CPC ..... *A47K 13/302* (2013.01); *E03D 9/05* (2013.01); *E03D 11/02* (2013.01)

(58) Field of Classification Search

CPC ..... A47K 13/00; A47K 13/10; E03D 9/05; E03D 11/02

USPC ..... 4/233

See application file for complete search history.

(56) References Cited

U.S. PATENT DOCUMENTS

| | | | | |
|---|---|---|---|---|
| 4,853,982 A * | 8/1989 | Martinval | ..... | A47K 13/302 4/233 |
| 2010/0229295 A1* | 9/2010 | Hiranuma | ..... | E03D 11/025 4/434 |

FOREIGN PATENT DOCUMENTS

| | | | |
|---|---|---|---|
| CN | 205636985 U | 10/1916 | |
| CN | 2563198 Y | 7/2003 | |
| CN | 1824896 A | 8/2006 | |
| CN | 101089304 A | 12/2007 | |
| CN | 102824136 A | 12/2012 | |
| CN | 204112445 U | 1/2015 | |
| DE | 3916371 A1 | 11/1990 | ..... A47K 13/16 |
| EP | 0274588 A2 | 7/1988 | ..... E03D 9/00 |
| EP | 2898807 A1 | 7/2015 | ..... A47K 13/30 |
| ES | 2553156 A1 | 12/2015 | ..... A47K 13/30 |
| FR | 2592667 A1 | 7/1987 | ..... E03D 9/00 |

(Continued)

OTHER PUBLICATIONS

International Search Report and Written Opinion, Application No. PCT/DE2017/000102, 16 pages, dated Oct. 19, 2017.

(Continued)

*Primary Examiner* — Christine J Skubinna

(74) *Attorney, Agent, or Firm* — Slayden Grubert Beard PLLC

(57) ABSTRACT

Various embodiments include a flushing and cleaning system for a toilet device comprising: a toilet bowl; a toilet seat; a toilet lid; and a cleaning volume separated from the toilet bowl. The toilet seat can be disposed in the cleaning volume for cleaning purposes.

16 Claims, 8 Drawing Sheets

(56) References Cited

FOREIGN PATENT DOCUMENTS

| | | | | |
|---|---|---|---|---|
| FR | 2603054 | A1 | 2/1988 | ..... A47K 13/30 |
| FR | 2686240 | A1 | 7/1993 | ..... A47K 13/30 |
| JP | 6163995 | U | 5/1986 | |
| JP | 03202031 | A | 9/1991 | |
| JP | 03244419 | A | 10/1991 | |
| JP | 05137670 | | 6/1993 | |
| JP | 06197849 | A | 7/1994 | |
| JP | 3062688 | U | 10/1999 | |
| JP | 2000265529 | A | 9/2000 | |
| JP | 2002209797 | A | 7/2002 | |
| JP | 2010268930 | A | 12/2010 | |
| WO | 2018/149427 | A1 | 8/1918 | ..... A47K 13/30 |
| WO | 2008/072677 | A1 | 4/2010 | |
| WO | 2013/167919 | A2 | 11/2013 | |

OTHER PUBLICATIONS

Japanese Office Action, Application No. 2019565607, 27 pages.
Indian Office Action, Application No. 201917033275, 7 pages.

* cited by examiner

FLUSHING AND CLEANING SYSTEM AND FLUSHING METHOD FOR A TOILET

CROSS-REFERENCE TO RELATED APPLICATIONS

This application is a U.S. National Stage Application of International Application No. PCT/DE2017/000102 filed Apr. 10, 2017, which designates the United States of America, and claims priority to DE Application No. 10 2017 001 775.1 filed Feb. 20, 2017, the contents of which are hereby incorporated by reference in their entirety.

TECHNICAL FIELD

The present disclosure relates to toilets. Various embodiments may include flushing and cleaning systems and/or flushing methods for a toilet.

BACKGROUND

In typical flushing devices for toilets, water is mainly or exclusively used as the flushing agent. Flushing pressure is generated by gravity. Due to environmental considerations the consumption of potable and/or drinking water for flushing toilets is not desirable. Therefore, the search for alternatives makes sense.

In order to save water during the flushing process, some systems use compressed air in addition to water for flushing. DE 25 19 620 C3 ("toilet device for railway cars") describes a toilet device for railway cars, wherein between a fresh water tank and the toilet bowl an intermediate container is arranged, from which, when a pedal is actuated, controlled by a time relay a quantity of fresh water is pressed into the toilet bowl by means of stored compressed air. This causes a flushing of the toilet bowl with a reduced amount of water, so as not to have to empty the sewage tank of a train too often. However, the system still does not work without a considerable amount of water. Currently, about 6 to 9 liters of drinking water are used for a flushing process.

Another consumer demand related to toilet use is hygiene. Especially in public areas such as train stations, airports, restaurants, etc., it is desirable to find a clean toilet seat or to be able to resort to a way that allows a hygienic use of the toilet seat in use. Covers of toilet seats with paper pads are used to avoid or at least minimize the direct contact of the human body with the toilet seat. This can cause a problem in that the paper pads slip away, as they do not have a hold on the toilet seat and are difficult to rinse off with a water rinse, as they adhere to the interior of the toilet bowl, especially when moistened by the water rinse.

In this respect, DE 39 16 371 A1 describes a "toilet add-on device—compact and adaptable as a paper covering reservoir comprising an automatic application technique, as well as fecal odor extraction and water wetting the toilet bowl." Here rosette-shaped paper coverings can be placed on a toilet seat ring. The paper covering is taken from a store device. The paper is fixed under negative pressure or vacuum on this toilet seat ring. The flushing is done by a water flush in combination with a suction of air. However, only smooth paper variants are suitable, otherwise it must be sucked in with greater vacuum power. Torn or damaged paper pieces no longer adhere to the toilet seat ring, since the pressure is then no longer sufficient. In addition, the known solutions are technically complex. However, such devices are vulnerable to failures. Therefore, they are particularly inappropriate for public toilets that are designed for high numbers of users.

SUMMARY

The teachings of the present disclosure describe flushing and cleaning systems that allows a hygienic use of a toilet and at the same time provides environmentally sound cleaning. For example, some embodiments include a flushing and cleaning system (100) for a toilet device, comprising a toilet bowl (10) and at least one toilet seat (14, 16) and a toilet lid (12), characterized in that the flushing and cleaning system (100) comprises a cleaning space (24), which is formed separately from the space in which the toilet bowl (10) is arranged and in which the at least one toilet seat (14) or in the arrangement of two toilet seats (14, 16) each one of the two toilet seats (14, 16) can be arranged for cleaning purposes.

In some embodiments, the toilet seat or the toilet seats (14, 16) are designed to be movable so that they are movable into the cleaning space (24) and out of the cleaning space (24) by a moving device.

In some embodiments, the toilet seat or the toilet seats (14, 16) are formed rotatable into the cleaning space (24) and out of the cleaning space (24) by the moving device, which is designed as a rotating device.

In some embodiments, when the toilet device is not in use the toilet lid (12) completely closes the toilet bowl (10) and for using the toilet device the toilet lid (12) is movable into a storage position.

In some embodiments, at least two cleaning nozzles (26) are arranged in the cleaning space (24) so that the toilet seat (14, 16) can be sprayed in the cleaning space (24) from two different, opposite sides.

In some embodiments, at least two drying nozzles are arranged in the cleaning space (24) so that the toilet seat (14, 16) can be flushed with air for drying from two different, opposite sides.

In some embodiments, the cleaning space (24) has at least one waste water collecting vessel (38).

In some embodiments, the medium collected in the sewage collecting vessel (38) has a pressure inlet (40) towards the waste water of the toilet bowl (10).

In some embodiments, the waste water of the toilet bowl (10) and/or the cleaning space (24) can be discharged into the drainage pipe (48) by the addition of compressed air from compressed air nozzles (56, 58, 60, 62).

In some embodiments, the toilet lid (12) is formed in one or two parts and is foldable, slidable, pivotable or rotatable.

In some embodiments, the cleaning space (24) has a separator plate (28) and at least one seal (30).

As another example, some embodiments include a method for flushing and cleaning a toilet as described above, characterized by the steps of: a) opening a toilet lid (12), b) changing the position of the toilet lid (12) either into a space below a cleaning space (24) in an area between the cleaning space (24) and a waste water collecting vessel (38) or moving to a position next to a toilet bowl (10), c) after the toilet has been used, moving the used toilet seat (14, 16) into the cleaning space (24), d) cleaning the toilet seat (14, 16), and e) at the same time moving out the toilet lid (12), f) covering the toilet bowl (10) with the toilet lid (12), g) introducing compressed air through at least one nozzle (44, 50), h) flushing the toilet bowl (10) with the compressed air with or without supply of water, and i) introduction of rinsing goods into a drainage pipe (48).

In some embodiments, the cleaning space (24) has a waste water collecting vessel (38) which is filled with waste water of the cleaning process and whose waste water is discharged together with the waste water of the toilet bowl (10).

In some embodiments, two toilet seats (14, 16) are used and for cleaning in each case a toilet seat (14) or a toilet seat (16) is cleaned in the cleaning space (24), while the other toilet seat (14, 16) is arranged on the toilet bowl (10) and is free for use.

In some embodiments, the flushing process and the discharge of the rinsing goods into the drainage pipe (48) is supported by the introduction of compressed air from compressed air nozzles (56, 58, 60, 62).

In some embodiments, in the cleaning space (24) disinfectant, cleaning agents, fragrances or other additives are added to the cleaning water.

BRIEF DESCRIPTION OF THE DRAWINGS

An example embodiment of the teachings of the present disclosure is explained in more detail below with reference to the attached schematic drawings, wherein.

DETAILED DESCRIPTION

Figure 1:
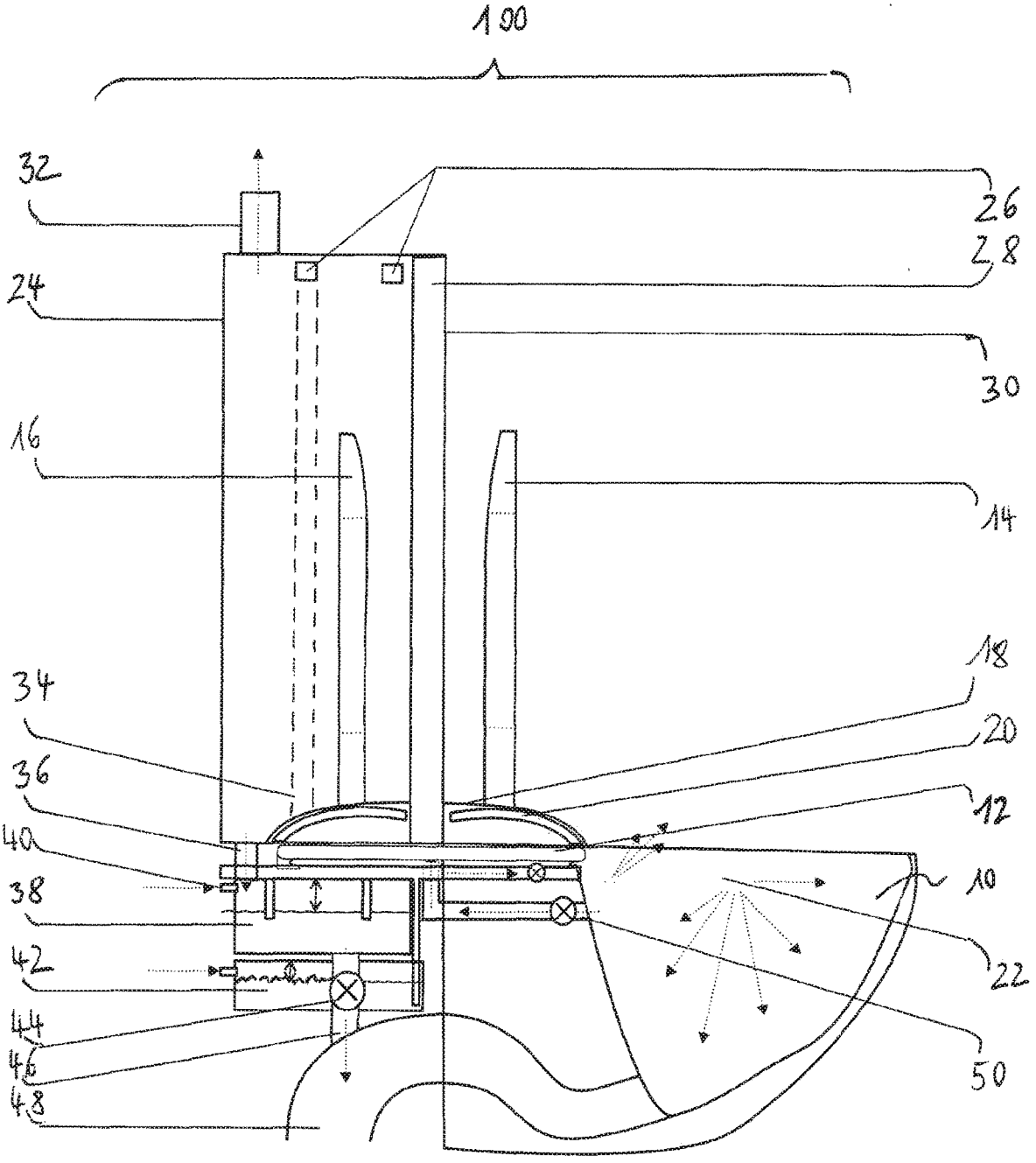
FIG. 1 shows a flushing and cleaning system incorporating teachings of the present disclosure, comprising a changeover mechanism and use of compressed air flushing viewed from the side.

Various embodiments of the teachings herein include flushing and cleaning systems and/or flushing methods for toilets in which a closed overpressure system is used as flushing agent for the removal of feces. In particular, the energy used is taken from the flushing cistern, which serves as an energy storage system to provide the overpressure and generate pressure differences. This overpressure is easily generated and made available. Usually it is already present in the water supply network. The compressed air flushing is combined with a cleaning process that allows reliable cleaning of a toilet seat after use.

In some embodiments, the flushing and cleaning system comprises several modules. These individual modules together form the flushing and cleaning system. The flushing and cleaning process includes a changeover mechanism and a cleaning space separate from the toilet bowl.

In some embodiments, the toilet bowl is arranged on a wall or a stem in front of the wall of a wet room or a bathroom. It may be adjustable in height and also be designed as a urinal or be designed in a special design for people with reduced mobility. It may be formed in a round, angular or spherical manner or the like. In some embodiments, the toilet bowl has a nearly hermetically closable toilet lid. The toilet bowl together with the toilet lid forms a closed device.

This toilet lid is placed in a storage space behind the toilet bowl, either in the wall or in a stem between the wall and the toilet bowl, or otherwise removed from the toilet bowl during use of the toilet and covers the toilet bowl when not in use. In a covered state it is arranged in an area below the toilet seat and is movable into the storage space in its position for storage and then again is movable out of there for closing or covering the toilet bowl. The toilet lid may be pushed, folded, swiveled or the like and may be formed, for example, in two parts or hemispherical. If it is formed in two parts, it can be unfolded by opening the two halves on both sides.

In some embodiments, one or more toilet seats may be placed on the toilet bowl. In some embodiments, the second toilet seat is provided as a reserve seat. It can be cleaned when the other toilet seat resting on the toilet bowl is in use and is then made available to another toilet user in the cleaned state, while at the same time, or only slightly later, the other toilet seat is subjected to a cleaning process. The usage depends on the frequency of use. The toilet seat may also be electrically heated.

In some embodiments, a cleaning method includes moving a toilet seat into a cleaning space. In particular, it can be folded, pivoted, and/or rotated. Cleaning takes place inside the cleaning space without contamination by vapors. The resulting used air is sucked off and condensed. This may be done via an exhaust condenser. The exhaust condenser, in some embodiments, may be arranged laterally to take up little space. The vapors may be removed into the appropriate lines via a fan. Any resulting condensation may be drained off through the drainage.

In some embodiments, any exhaust air from the toilet bowl is aspirated at the same time. Disinfection may be carried out by additives, e.g., disinfectants. Cleaning and care additives can be exactly metered. These may be decalcifiers, fragrances, disinfectants, water softeners, etc. The toilet seat can be dried with air with or without a fan.

In some embodiments, the cleaning space is formed behind the rear wall on which the toilet bowl is arranged. The existing space in conventional concealed flushing cisterns usually is sufficient. The cleaning space is accessible from the front, from where the toilet is located. Fixation and sealing may be achieved by means of seals. These form a cover with the rear wall. The seals may, for example, close from the sides and thus enable a fixation, sealing as well as the space for rotating the toilet seat.

This rotation in particular may be done using a rotary unit. It performs a rotational movement and rotates by 180°. The back wall behind the toilet bowl thus forms a cover for the cleaning space. Thus, the cleaning space is closed. The toilet seat may be folded up and moved into the cleaning space by a transport device. It may be rotated by the rotating device by 180°. Then a cleaning process takes place. Therefore, there is no waiting time during the cleaning process for the user of the toilet, since the other, already cleaned toilet seat is rotated by 180° forward for use from the rear out of the cleaning space. The user may use the toilet unhindered. The usage time therefore corresponds to the cleaning time if two toilet seats are available. Thus, a turning unit, in some embodiments a rotary unit, is used for the cleaning process.

In some embodiments, the toilet seat may be cleaned from the front and from the back inside the cleaning space. To do so, water or detergent jets may be directed against each other. Water may be removed from the surfaces at the same time and the water is discharged into the container provided for this purpose. Drying may also be done on both sides.

In some embodiments, during the cleaning process, water is collected, and the toilet bowl is vented in a controlled manner. The pressure accumulator is filled in particular with the water from the cleaning process. Pressure is built up in the previously unpressurised water storage device by inflowing water. The toilet lid closes. The pressurized wastewater flows through a separate line into a drainage pipe. In the wastewater space negative pressure is created. Any resulting coarse dirt particles are separated during cleaning in a coarse dirt collector and directed into the drainage system separately.

In some embodiments, the water or the liquid used for the cleaning process can be used as a support for the flushing process. The water or cleaning agents required for cleaning the toilet seats otherwise flow into a collecting container after the cleaning process. This container captures the accumulating wastewater, cleaning agents, descaler, disinfectants, fragrances, and the like. This mixture of liquid substances may be discharged via the house management or also may be introduced into the domestic drainage via a pumping system. Cleaning nozzles may be arranged in the interior of the toilet bowl.

In some embodiments, when two toilet seats are in use, one toilet seat is arranged in a space in the wall, in particular the cleaning space, or is arranged in the corresponding stem. To use the toilet, the toilet lid—whether triggered automatically or manually—may be moved, e.g., folded, pushed, pivoted, unfolded, or the like, and the other toilet seat is moved at about the same time from the storage space onto the toilet bowl and is placed on the edge of the toilet bowl. This can be done by moving the toilet seat into its position by means of a rotary movement.

After the usage the toilet seat is again brought into the space provided and there it is subjected to cleaning. There must be at least one toilet seat, but there may also be one or more additional toilet seats in stock to be replaced if necessary and to subject the respective toilet seat not in use to a cleaning process. The toilet seat is designed to fully enclose the upper portion of the toilet bowl so that nothing can splash outward from the toilet bowl.

In some embodiments, during the flushing process the overpressure is synchronously introduced into the closed toilet bowl and into the discharging supply line. The overpressure is thus derived from the flushing cistern. The medium flowing quickly into the disposal line, e.g. liquid and air, creates a negative pressure downstream of the inflowing point according to the principle of a venturi nozzle and thus sucks in the contents of the bowl. The overpressure generated in the toilet bowl increases the pressure difference and moves the bowl contents towards the disposal line.

With the overpressure method, this energy impact can be used to empty the toilet bowl. Only the smallest amounts of water are needed and a variant without water use is also provided. In some embodiments, 100 ml of liquid and 0.2 bar of overpressure are provided for the discharge. By means of the closure of the toilet bowl with the toilet lid when flushing no contaminated germs or water vapor penetrate into the room air. This improves the flushing process.

In some embodiments, the flushing process only takes place if sufficient pressure is built up. As soon as the toilet lid is closed, there is sufficient energy, e.g. overpressure in the pressure accumulator, so that emptying the toilet bowl without any further energy source is possible. If several rinses are necessary, the reservoir is filled and overpressure is generated, or this can possibly be generated alternatively by means of a hand pump. This is also a variant that is applicable in states with energy supply problems. Operation of the flushing and cleaning system is therefore possible without connection to other detergent sources. For discharge into the pipe system also supplied water or, for example, a gas mixture in the pipe system behind the toilet bowl may be used. A thus resulting negative pressure before the introduction creates a greater pressure difference between the toilet bowl and the pipe system, sucks the medium out of the toilet bowl and supplies the energy for transport within the pipe system to the downpipe. Therefore, older and longer drainpipes are further usable.

A flushing and cleaning system incorporating the teachings herein thus enables a waterless variant. If, for example, a paper insert is placed in the toilet bowl as a sliding medium so that the feces do not touch the edge of the bowl, the principle of a "pneumatic tube" is created, which can transport the contents even anhydrous into the pipeline network. A following processing of the feces is much simpler as there is no need to separate water. When introducing the feces into a transport container the volume is reduced to the amount of fecal matter. The "paper" is formed of a material that is especially formed from natural materials such as straw. This material, together with the feces, can be heat treated as a high-quality fertilizer and may be used immediately.

To accommodate the items to be washed, i.e. the fecal matter and the paper covering and used toilet paper, a disposal container is required in the waterless variant. This may be a disposable or a reusable container and is supplied to a collection. The contents are disposed of separately or can be processed into a fertilizer, for example. The included paper of the paper covering, and the toilet paper have been compressed during the flushing process by the compressed air with the overpressure.

A flushing and cleaning system incorporating teachings herein may also allow for a variant of flushing with water. The need for comfort of people becomes increasingly extensive. Water plays a central role in this context. This is also the case with toilet hygiene. Water plays a central role. At the same time, however, water is becoming an increasingly scarce resource. It is therefore desirable to use water no longer primarily as an energy medium. The saving of water in the toilet flushing in the known manner, however, could cause a silting or pollution of the pipeline network with significant follow-up costs. By using the flushing and cleaning systems described herein, the water of the toilet cleaning can be used for transport within the pipeline network and creates the possibility to further reduce the amount of water in the flushing water. Even in long or difficult old pipeline networks, a discharge is possible, even if the flushing water quantities are getting increasingly lower. The existing pipeline network remains intact.

The compressed air also usable for flushing—for the waterless as well as for the water-using variant—can be generated in particular for itself or in combination with the water pressure by compressing air with a compressor. The compressed air may then be stored in a pressure vessel. However, the pressure may also be generated by means of other alternatives, such as hot water (steam), mechanical (pump), mechanical (water pressure from the supply network), electric (compressor), hydraulic (pump) or with spring force by biasing, compressed gas, gas mixtures, or by solar energy.

In a simpler home version, for home use or for use in restaurants, only one toilet seat is used, which is cleaned after each use. For a reliable flushing of the toilet bowl no further rinses are required when using compressed air.

A flushing and cleaning system incorporating teachings of the present disclosure, requires only little or no fresh water or drinking water for flushing and thus the flushing and cleaning system forms an environmentally friendly device. The cleaning allows a hygienic and clean toilet use with an always freshly cleaned toilet seat. Further advantages and advantageous embodiments of the teachings herein can be taken from the following description of the figures, the drawings and the claims.

In FIG. 1, a flushing and cleaning system 100 is shown. A toilet bowl has a toilet lid 12. Furthermore, a first toilet seat 14 and a second toilet seat 16 are formed. The toilet seats 14, 16 are formed lowerable by a lowering unit 18. Below the first toilet seat 14, a washing nozzle 20 is formed. Within the toilet bowl, a first cleaning nozzle 22 is formed.

Separated from the space in which the toilet bowl 10 is arranged, a cleaning space 24 is arranged. The cleaning space 24 has second cleaning nozzles 26 and a separator plate 28. The separator plate 28 is sealed with seals 30. At the cleaning space 24, an exhaust condenser 32 is arranged. Within the cleaning space 24, at least one guide 34 is formed for the cleaning devices, for example for the water spray devices or drying devices.

Figure 2:
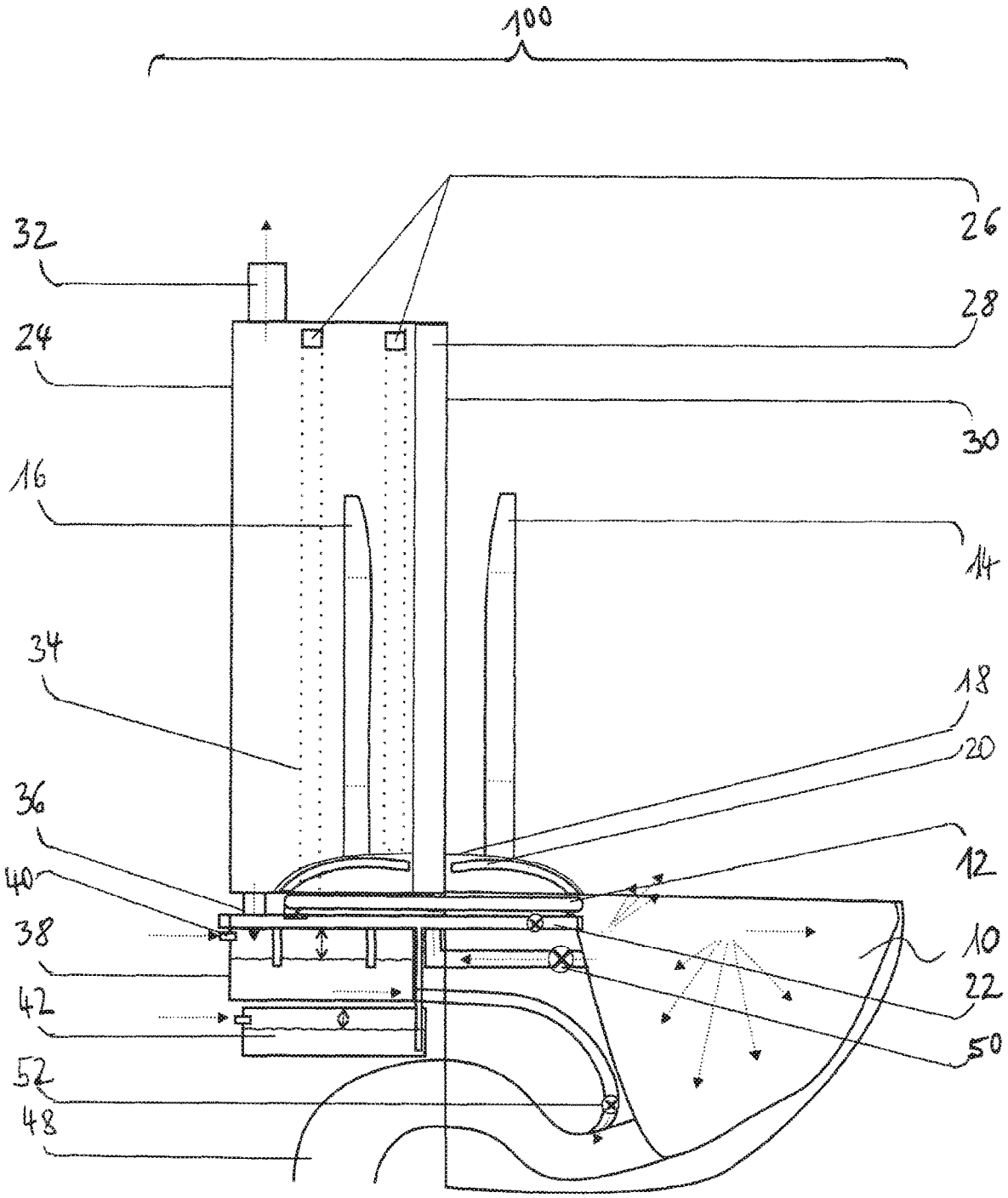
FIG. 2 shows a flushing and cleaning system with a variant of the valve arrangement incorporating teachings of the present disclosure also viewed from the side.

The cleaning space 24 has a diaphragm valve 36. Furthermore, a wastewater collecting vessel 38 is formed, which has a pressure feed 40. A feed line reservoir 42 is formed. Furthermore, a first shut-off valve 44 and a drain 46 for the sewage collecting vessel 38 are formed. The drainage takes place via the drainage pipe 48. In FIG. 2, in addition to the features shown in FIG. 1 a shut-off valve 52 is formed for the sewer tank 38. The illustrated discharge takes place directly into the odor trap. The discharge may be designed differently.

Figure 3:
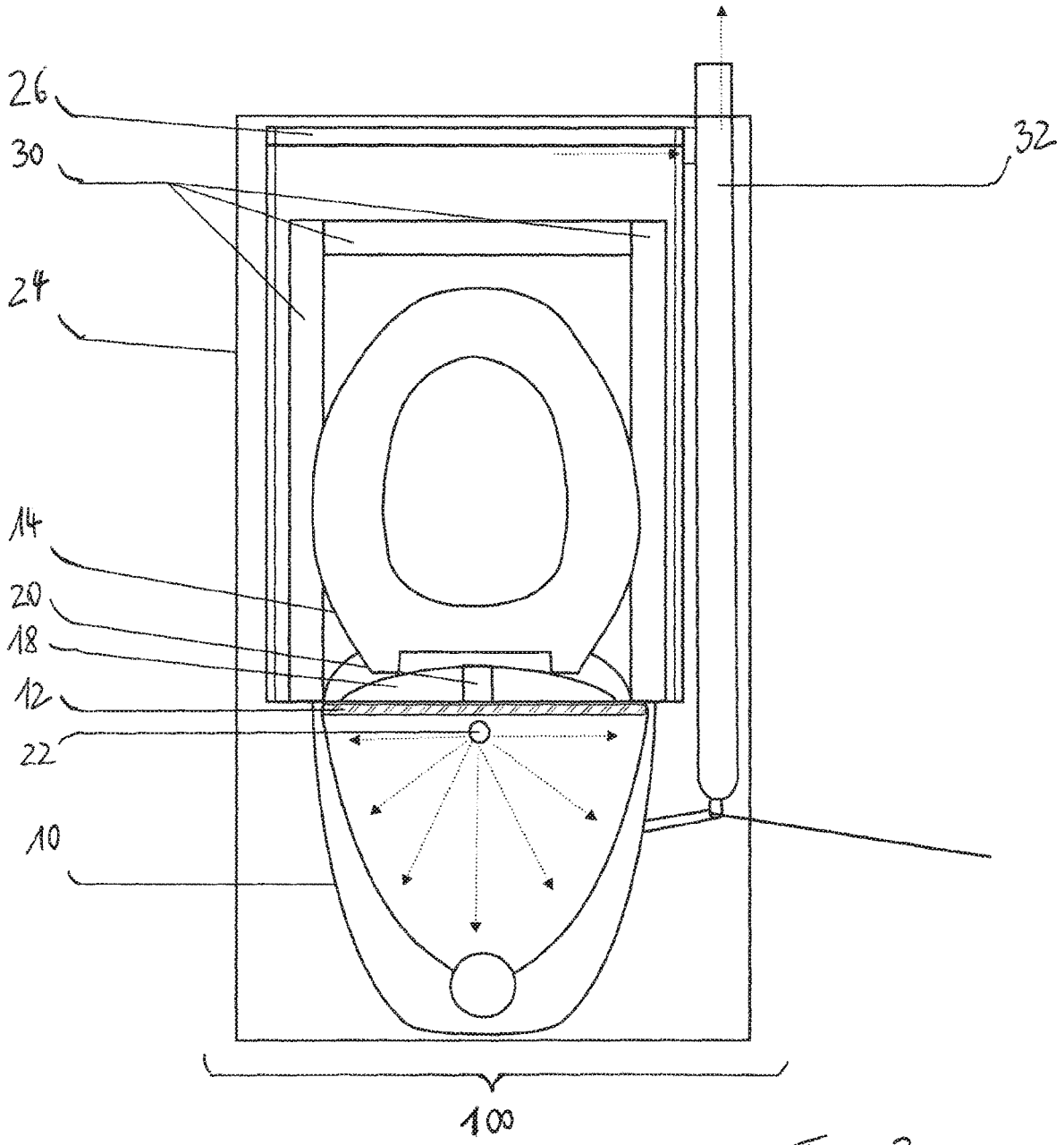
FIG. 3 shows a flushing and cleaning system incorporating teachings of the present disclosure in a frontal view.
Figure 4:
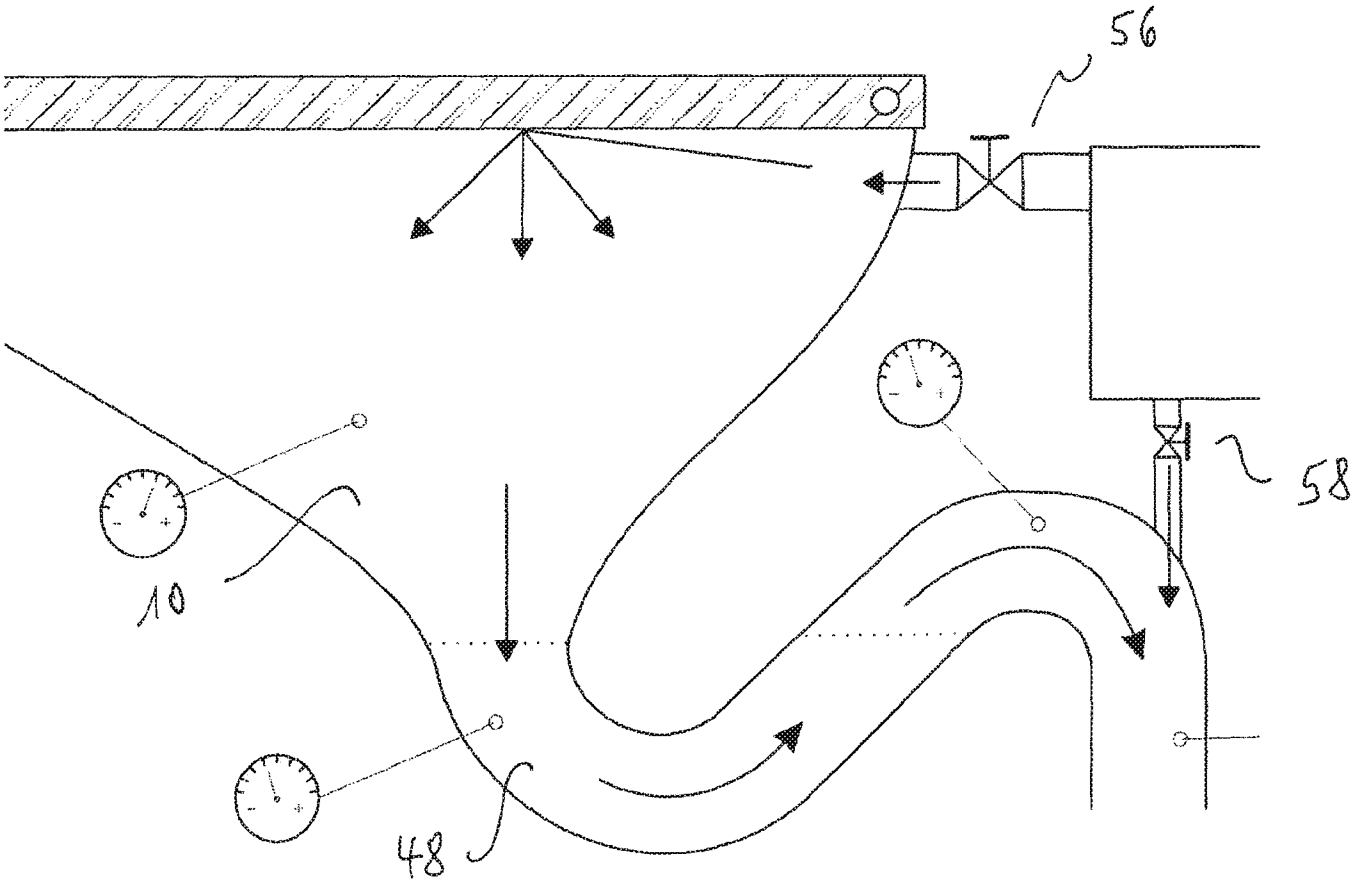
FIG. 4 shows a toilet bowl incorporating teachings of the present disclosure with pressure-forming valves in a side view.

FIG. 3 shows a frontal view of the toilet bowl 10 comprising the toilet lid 12 and the toilet seat 14. Also shown is the washing nozzle 20 and the lowering unit 18. Within the toilet bowl 10, the first cleaning nozzle 22 is shown. The cleaning space 24 has seals 30 and second cleaning nozzles 26. An exhaust air condenser 32 is arranged laterally in the cleaning space 24. Therefore, the drain 54 of the exhaust condenser 32 is formed at the lower end thereof. FIG. 4 illustrates the toilet bowl 10 and the drainage pipe 48. To generate a compressed air surge or the compressed air regulation, respectively, in particular a first nozzle 56 and a second nozzle 58 are formed. In some embodiments, a cylindrically symmetrical flow of the supply air is guided through a short constriction, so that an increase in pressure takes place. For ideal gases, the extended Bernoulli equation applies. When the flow reaches the speed of sound, the Venturi nozzle becomes a Laval nozzle. Due to the achieved compressed air surge, the run-off of the wastewater-air mixture is greatly facilitated.

Figure 5:
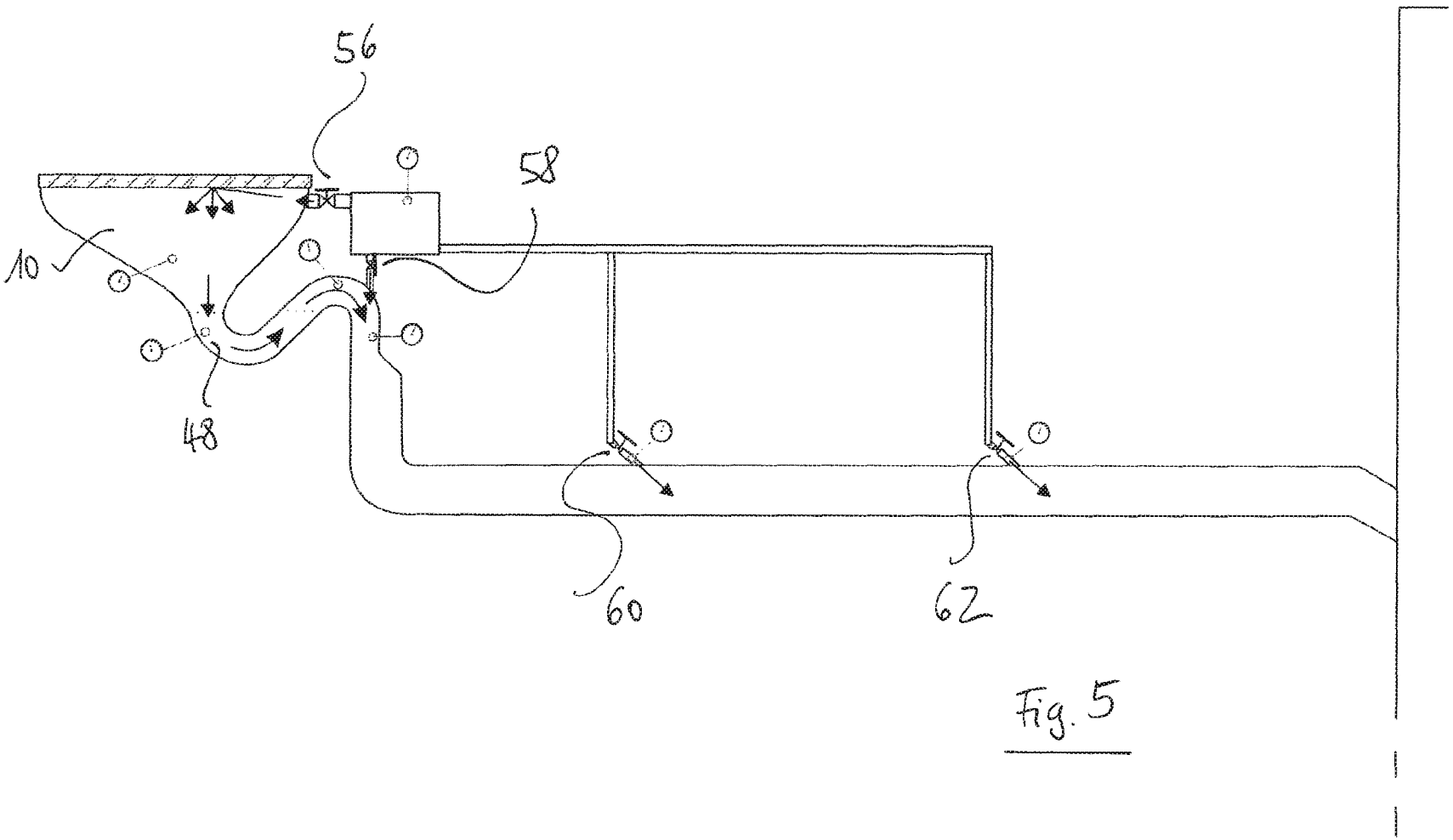
FIG. 5 shows a toilet bowl incorporating teachings of the present disclosure with water as a transport medium viewed from the side.

In FIG. 5, the variant of FIG. 4 comprising water as a transport medium into pipeline networks comprising long distances or bad lines is shown. Further nozzles 60, 62, e.g., Venturi nozzles, may be arranged for the inclusion of compressed air or water mixture in the wastewater. This application prevents deposits and constrictions in the pipeline system and allows for better drainage.

Figure 6:
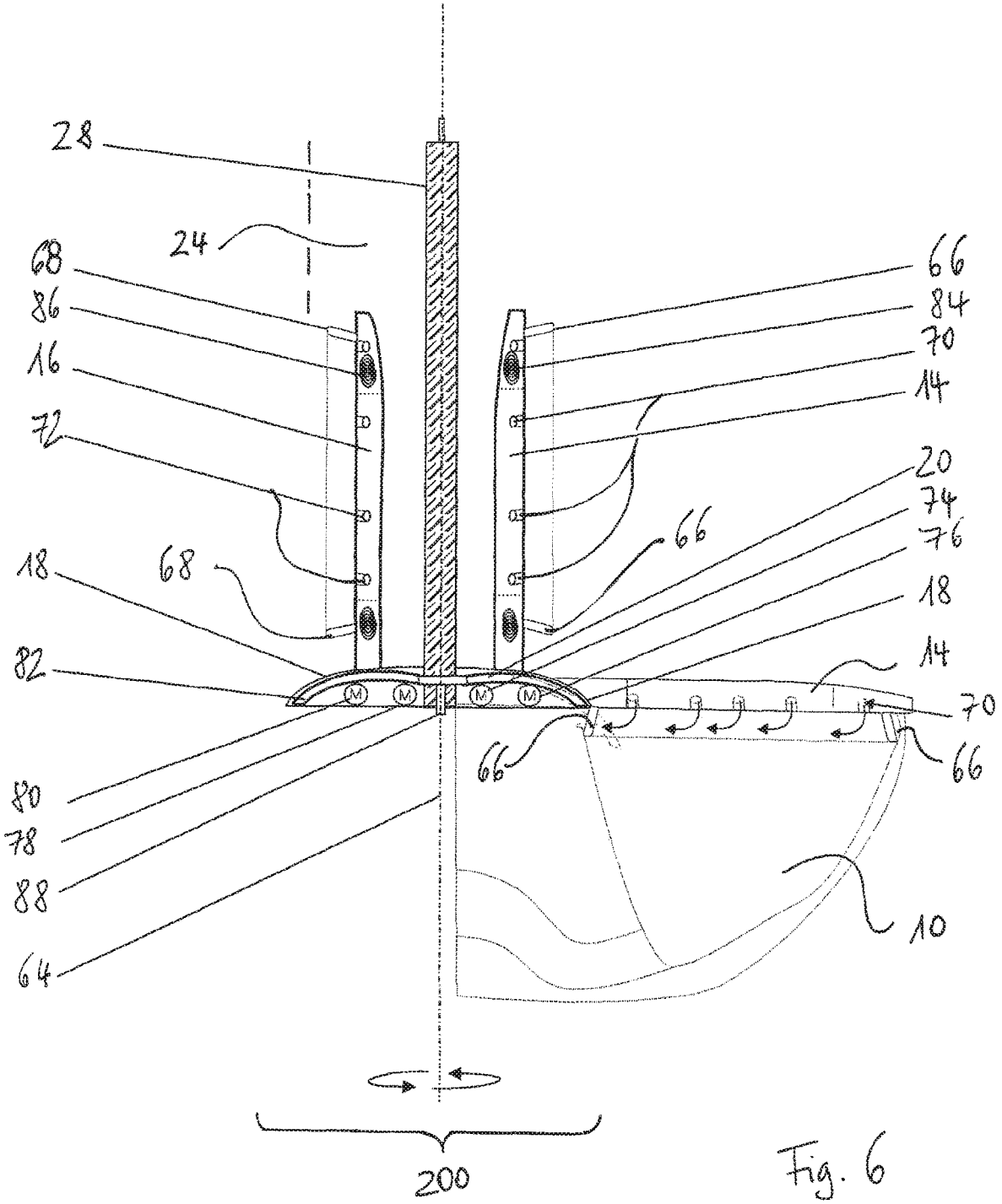
FIG. 6 shows a rotary unit for toilet seats incorporating teachings of the present disclosure viewed from the side.

FIG. 6 is a detailed view of a rotary unit 200. The toilet seats 14 and 16 can be rotated by 180° by means of this rotation unit 200 about a rotation axis 64 and thereby be transported into the cleaning space 24. The cleaning space 24 (indicated by dashed lines) is separated from the space in which the toilet bowl 10 is arranged by the separator plate 28. The lowering units 18 are formed identical in this embodiment and may operate independently. In this embodiment, two toilet seats 14, 16 are shown. However, also only one toilet seat 14 may be arranged, which can be rotated into the cleaning space 24 in the same way by rotation unit 200. To clean the toilet system, the toilet seat 14 is placed on the toilet bowl 10. The toilet seat 14 has a splash guard 66 on its underside, the toilet seat 16 a splash guard 68. This splash guard 66, 68 is formed to exactly fit the shape of the toilet bowl 10. As a result, there is no gap or clearance between the respectively placed toilet seat 14, 16 and the toilet bowl 10. The spraying onto the underside or even the spraying to the outside during the cleaning function, during a shower function or the toilet use is prevented.

Ventilation of the toilet bowl 10 is effected by supply air, which is introduced by air channels 14, 16 arranged in the toilet seat. As a result, no spraying to the outside is possible. When the toilet seat 14 is lowered, the washing nozzle 20 enters between the toilet seat 14 and the toilet bowl 10. For the lowering process a motor 74 is arranged. Furthermore, a motor 76 for the washing nozzle 20 is arranged. Motors are also provided for the toilet seat 16, namely the motor 78 for the lowering of the lowering unit 18 and the motor 80 for a washing nozzle 82. The toilet seats 14, 16 each have facilities for a seat heater. These are the heaters 84 of the toilet seat 14 and 86 of the toilet seat 16.

As an alternative to the illustrated rotating mechanism, other moving devices may be used to facilitate the movement of the toilet seat or seats 14, 16 into the cleaning space 24. These are pivoting, sliding, hinged or differently designed devices or methods for transporting the toilet seats 14, 16.

On the rotation axis 64 of the rotation unit 200, a water inlet 88 is arranged. Also located there is the electrical supply line. The cleaning of the toilet seats 14 and/or 16 takes place after their movement or displacement into the cleaning space 24.

Figure 7:
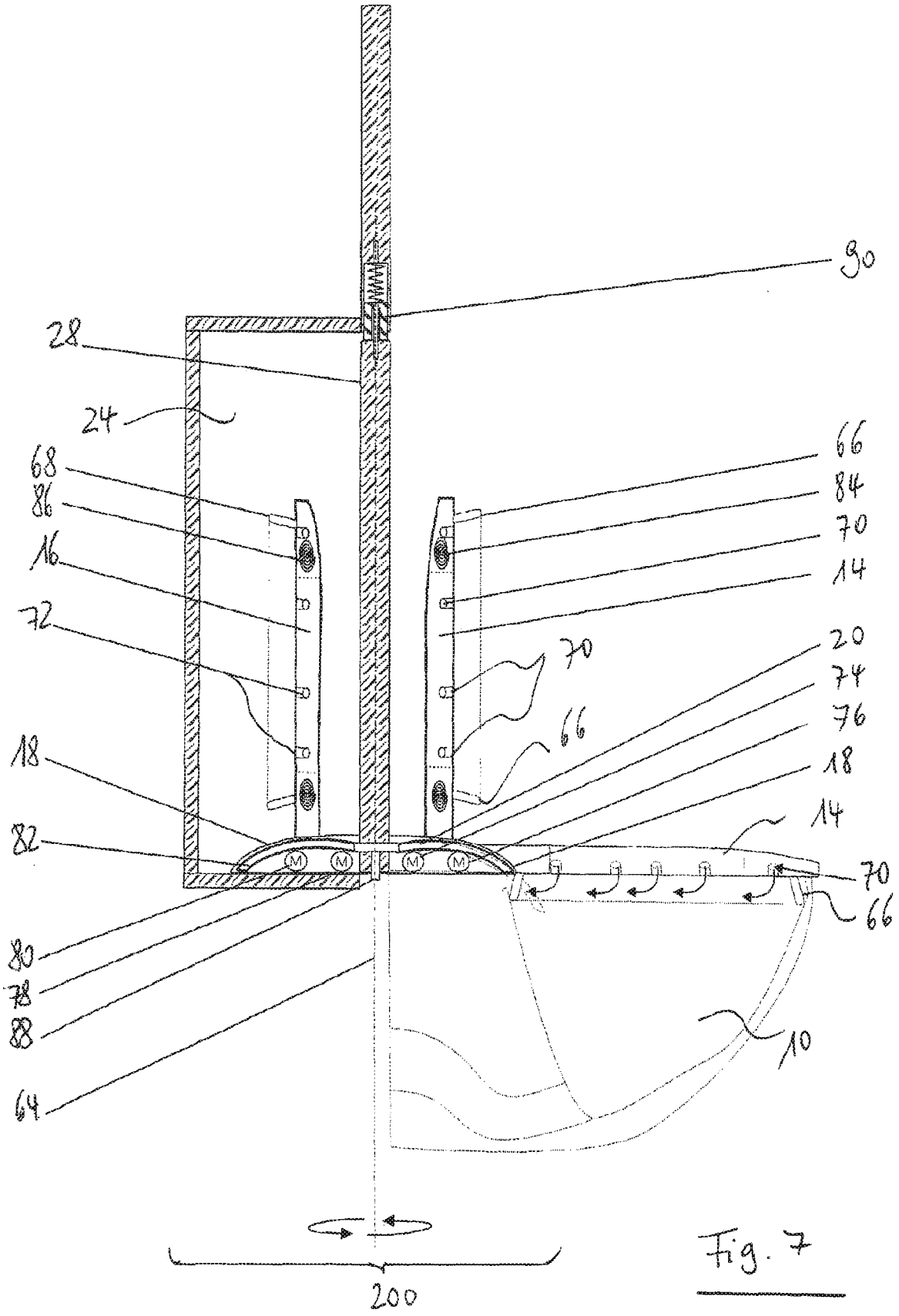
FIG. 7 shows the rotary unit of FIG. 6 with a seal viewed from the side.

In FIG. 7, the cleaning space 24 of FIG. 6 is shown. A seal 90 is arranged for sealing. The arrangement of the individual devices in the form described causes that all parts coming into contact with the toilet user can be cleaned. Thus, no more washing nozzles are arranged within the toilet bowl. This was and is considered as unpleasant and unhygienic by the toilet user. Likewise, by the arrangement according to the invention a spurting of liquids and the like under the toilet seat 14, 16 is reliably prevented during cleaning and/or use. By cleaning the toilet bowl 10 according to the invention on the one hand and the reliable, hygienic cleaning of the toilet seats 14, 16, the cleaning effort in care, hospital, restaurant and other applications is significantly reduced.

Figure 8:
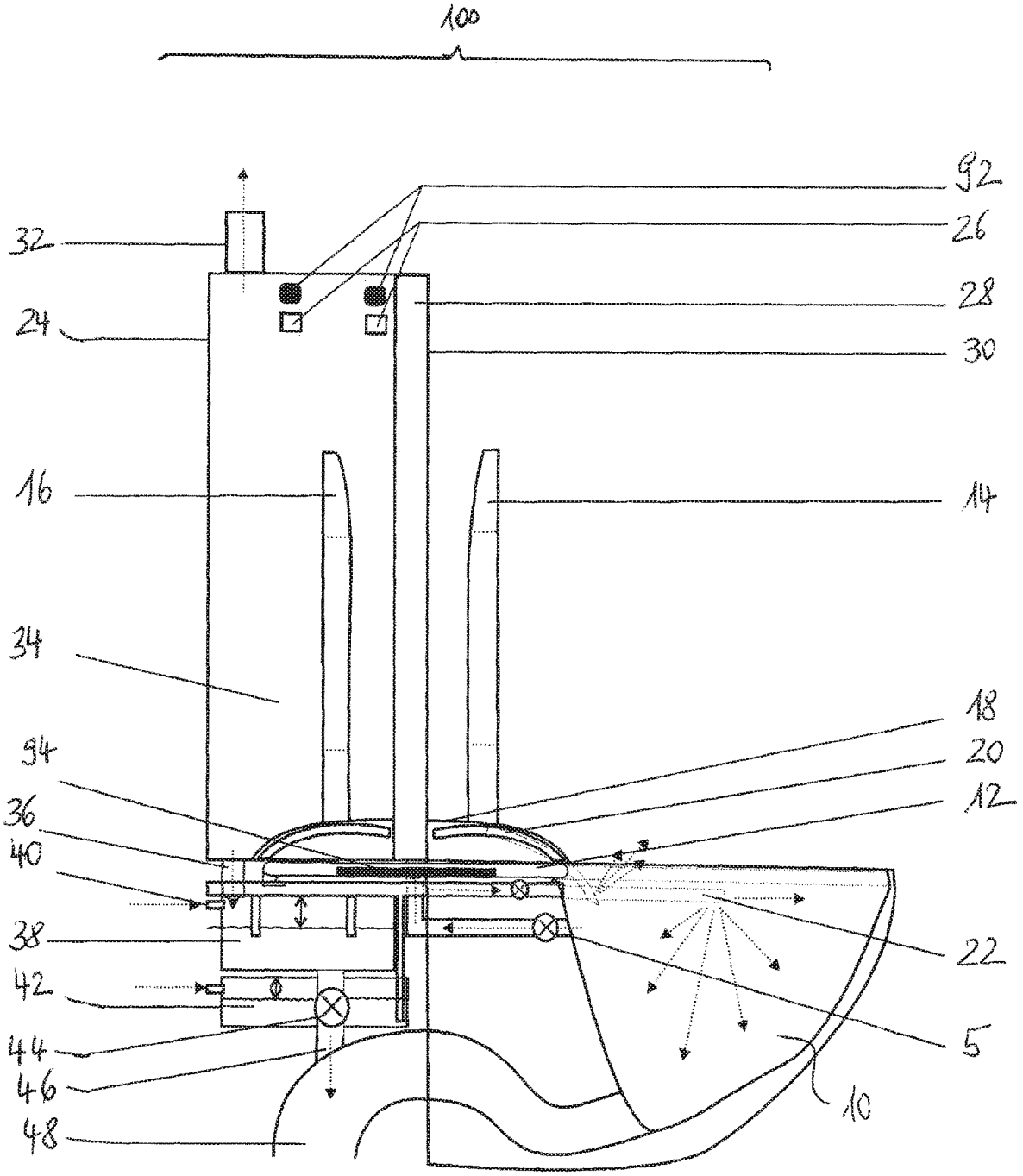
FIG. 8 shows an example system incorporating teachings of the present disclosure.

FIG. 8 shows an example system 100 incorporating teachings of the present disclosure.

LIST OF REFERENCE NUMBERS

10 toilet bowls
12 toilet lids
14 first toilet seat
16 second toilet seat
18 lowering unit
20 first wash nozzle
22 first cleaning nozzle
24 cleaning space
26 second cleaning nozzle (s)
28 separating plate
30 seal
32 exhaust condenser

34 guide cleaning
36 diaphragm valve
38 wastewater collection vessel
40 pressure feed
42 feed line reservoir
44 first shut-off valve
46 process
48 drainage pipe
50 supply/exhaust air for
52 second shut-off valve
54 outflow of 32
56 first nozzle
58 second nozzle
60 third nozzle
62 fourth nozzle
64 rotation axis
66 first splash guard
68 second splash guard
70 first air channels
72 second air channels
74 first engine
76 second engine
78 third engine
80 fourth engine
82 second washing nozzle
84 first seat heating
86 second seat heating
88 water inlet
90 seal
100 flushing and cleaning system
200 rotation unit

What is claimed is:

1. A flushing and cleaning system for a toilet device, the system comprising:

a toilet bowl;

a toilet seat;

a toilet lid with a first closed position between the toilet bowl and the toilet seat, forming a seal against the toilet bowl and a second open position; and a cleaning volume separated from the toilet bowl, wherein the toilet seat can be disposed in the cleaning volume for cleaning purposes.

2. The flushing and cleaning system according to claim 1, further comprising a moving device operable to move the toilet seat into the cleaning volume and out of the cleaning volume.

3. The flushing and cleaning system according to claim 2, wherein the moving device rotates the toilet seat into the cleaning volume and out of the cleaning volume.

4. The flushing and cleaning system according to claim 1, wherein the toilet lid moves into a storage in the open position.

5. The flushing and cleaning system according to claim 1, further comprising at least two cleaning nozzles arranged in the cleaning volume so that the toilet seat can be sprayed from two different, opposite directions.

6. The flushing and cleaning system according to claim 1, further comprising at least two drying nozzles arranged in the cleaning volume so that the toilet seat can be flushed with air for drying from two different, opposite directions.

7. The flushing and cleaning system according to claim 1, wherein the cleaning volume feeds into a waste-water collecting vessel.

8. The flushing and cleaning system according to claim 7, further comprising a pressure inlet from a wastewater collection in the toilet bowl to the wastewater collecting vessel.

9. The flushing and cleaning system according to claim 1, wherein waste water from the toilet bowl or the cleaning volume feeds into a drainage pipe along with compressed air fed from compressed air nozzles.

10. The flushing and cleaning system according to claim 1, wherein the toilet lid is foldable, slidable, pivotable, and/or rotatable.

11. The flushing and cleaning system according to claim 1, further comprising separator plate and a seal both at least in part defining the cleaning volume.

12. A method for flushing and cleaning a toilet, the method comprising:

after the toilet has been used, moving a toilet seat into a cleaning volume separated from a toilet bowl;

cleaning the toilet seat and at the same time moving out the toilet lid to form a seal against the toilet bowl with the toilet lid;

introducing compressed air through a nozzle into the toilet bowl, thereby flushing the toilet bowl with the compressed air with or without supply of water; and introducing rinsing goods into a drainage pipe.

13. The method according to claim 12, further comprising:

filling a waste water collecting vessel in the cleaning volume with waste water from the cleaning process; and discharging the waste-water together with waste-water from the toilet bowl.

14. The method according to claim 12, further comprising alternating the use of two toilet seats;

wherein in each case one of the two toilet seats is cleaned in the cleaning volume, while the other toilet seat is arranged on the toilet bowl and is free for use.

15. The method according to claim 12, further comprising introducing compressed air into the toilet bowl during the flushing process and the discharge of the rinsing goods into the drainage pipe.

16. The method according to claim 12, further comprising adding disinfectant, cleaning agents, fragrances, and/or other additives to the cleaning water in the cleaning volume.

* * * * *